US006494330B1

(12) United States Patent
Montgon et al.

(10) Patent No.: US 6,494,330 B1
(45) Date of Patent: Dec. 17, 2002

(54) VARIABLE LENGTH CRANE JIB WITH AUTOMATIC BALANCING

(75) Inventors: Denis Montgon, Canet en Roussillon (FR); Alexis Montgon, Perpignan (FR)

(73) Assignee: Societe Montgon Inventions Systemes, Canet en Roussillon (FR)

( * ) Notice: Subject to any disclaimer, the term of this patent is extended or adjusted under 35 U.S.C. 154(b) by 20 days.

(21) Appl. No.: 09/717,816

(22) Filed: Nov. 21, 2000

(30) Foreign Application Priority Data

Nov. 25, 1999 (FR) ..... 99 14819

(51) Int. Cl.[7] ..... B66C 23/76
(52) U.S. Cl. ..... 212/196
(58) Field of Search ..... 212/196

(56) References Cited

U.S. PATENT DOCUMENTS

| | | | | | |
|---|---|---|---|---|---|
| 3,073,343 | A | * | 1/1963 | Mowell et al. | 137/615 |
| 3,266,636 | A | * | 8/1966 | Dorn | 212/196 X |
| 3,340,907 | A | * | 9/1967 | Bily | 212/196 X |
| 3,362,432 | A | * | 1/1968 | Jameson | 212/196 X |
| 3,743,049 | A | * | 7/1973 | Levrini | 212/196 X |

FOREIGN PATENT DOCUMENTS

| | | | | |
|---|---|---|---|---|
| DE | 809350 | * | 7/1951 | 212/195 |
| GB | 2258445 | * | 2/1993 | 212/196 |
| RU | 616230 | * | 7/1978 | 212/195 |

* cited by examiner

*Primary Examiner*—Steven A. Bratlie
(74) *Attorney, Agent, or Firm*—Darby & Darby

(57) ABSTRACT

The rear extremity of the auxiliary arm 7, integral with each side of a throat pulley 10', 10" is joined to the front extremity of the main arm 3 around the spindle 6. The arms 13', 13" of the counterweight 14 are each integral with a throat pulley 28', 28" and are joined around the spindle 12 at the rear extremity of the main arm 3. A flexible cable 27', 27" is placed on each pair of pulleys 10', 28' and 10", 28" whilst being fixed at a point of each of the two pulleys. Control by a twin effect hydraulic thrustor 16 for the simultaneous movement of the cables 27', 27" towards the front ensures a tilting of the auxiliary arm 7 and simultaneous lifting of the counterweight 14 obtaining the automatic balancing of the jib.

The invention ensures the automatic balancing of the jib of the crane whilst eliminating the presence of variable lever arms.

14 Claims, 2 Drawing Sheets

VARIABLE LENGTH CRANE JIB WITH AUTOMATIC BALANCING

FIELD OF THE INVENTION

The present invention concerns jib cranes with articulated or telescopic arms for lifting or handling loads on the grab, with a grab bucket, a grab bucket, winch or hook. It concerns in particular a device ensuring an automatic balancing of the jib of these cranes according to the variation of the length of the jib.

BACKGROUND OF THE INVENTION

In cranes of this type, the jib is generally joined onto the turret and is equipped with a "variable geometry" counterweight mounted on a lever arm which is deployed at the rear of the jib according to the position of the auxiliary arm of the jib. In this case, the counterweight is only used to reduce the unloading time by a fixed value without compensation depending on the length of the jib.

So as to ensure the automatic action of balancing, the document EP-A-0 033 060 concerns mechanically connecting the auxiliary arm and the counterweight by a rigid connecting rod determining a ductile parallelogram. To obtain the same ends, the document EP-A 0 110 786 concerns a system of interconnected hydraulic thrustors simultaneously activating the auxiliary arm and the counterweight.

The above-mentioned systems for balancing elements of the jig are shown to be effective, but, as they comprise variable lever arms, have the drawback in that the torque required for balancing the elements of the jig is not constant, but gradually reduces the increase of the length of the jig and hence a considerable increase of the power is required for lifting of the load. These known devices also have the drawback in that, owing to their design, the kinematics of the movements of the jig are limited. Finally, the weight of the linking connection rod (in the device of the document EP-A-0 033 060), like the weight of the thrustor of the auxiliary arm (in the device of the document EP-A-0 110 786) penalises the system.

The document U.S. Pat. No. 4,252,162 describes a loading arm for transferring products, such as petrol products, between two cisterns or tanks. This loading arm includes an internal tube borne by a support with a control thrustor for varying the position of the internal tube with respect to the support, an external tube joined to one extremity of the internal tube and a balancing girder joined to the other extremity of the internal tube. A link constituted by pulleys and cables is embodied between the external tube and the balancing girder by connecting the position of these two elements. A thrustor for controlling the external tube is borne by the internal tube and the rod of this thrustor is coupled to the balancing girder so as to control the position of the external tube.

The object of the device of the document U.S. Pat. No. 4,252, 162 is therefore not the same as the device of the invention since this concerns a liquid loading arm, that is an articulated pipework for transferring liquid between two tanks and which is thus not subjected to heavy loads and not to a crane jig whose purpose is on the other hand to lift up and move heavy loads.

In addition, according to the document U.S. Pat. No. 4,252,162, the rod of the thrustor for controlling the external tube is coupled to the balancing girder so that, during control of the position of the external tube, there is thus a variation of the lever arm which prevents having a constant torque making it necessary to use a higher power control thrustor.

SUMMARY OF THE INVENTION

The aim of the present invention is to avoid the above-mentioned drawbacks of known devices and concerns equipping the crane jig with a balancing device which, whilst being extremely effective and relatively light, eliminates the need for variable lever arms and the drawbacks they involve concerning the power required for lifting the auxiliary arm, and improves the kinematics of movements of the jig.

To this effect, the variable length crane jig of the invention is of the type including a main arm mounted pivoting on a support turret, an auxiliary arm extending the main arm by being joined to the front extremity of the latter, a counterweight secured to an articulated rocking arm fixed to the rear extremity of the main arm, and linking means between said auxiliary arm and said rocking arm of the counterweight so as to realize at any moment a total or partial balancing of the jig. It is characterised in that said linking means include a first pulley system mounted in rotation at the front extremity of the main arm and integral in rotation with the adjacent extremity of the auxiliary arm, a second pulley system mounted in rotation at the rear extremity of the main arm and integral in rotation with the adjacent extremity of the rocking arm, a flexible link connecting a point of the first pulley system to a point of the second pulley system, and an element for controlling movement of the flexible link ensuring the simultaneous pivoting of the auxiliary arm and the rocking arm so as to modify the length of the jig whilst balancing the latter, said control element being borne by the main arm and being coupled to said flexible link so as to obtain a constant lever arm by keeping constant the torque required for balancing of the elements of the jig.

Advantageously, the front extremity of the main arm is extended by two spaced parallel arms between which the rear extremity of the auxiliary arm is placed, said rear extremity being integral on each of its opposing faces with a throat pulley, the unit formed by the rear extremity of the auxiliary arm and the pulleys pivoting around a hinge pin which pivots inside transversal openings opposite said parallel arms.

Similarly, the rocking arm integral with the counterweight has towards the front two parallel arms providing between them a space for the rear extremity of the main arm, said arms each being integral with a throat pulley, and the unit formed by the arms and the throat pulleys pivot around a hinge pin which pivots in a transversal opening of the rear extremity of the main arm.

On each side of the main arm of the jig, a flexible cable connects the front pulley to the rear pulley, said cable being fixed to one point of the front pulley and to one point of the rear pulley. Thus, the movement in a direction of the two flexible cables results in the rotation of the pulleys in a given direction by provoking with a constant lever arm the lifting up of the auxiliary arm and the simultaneous tilting of the counterweight, whereas the movement of these flexible cables in the other direction results in the rotation of the four pulleys in an opposite direction, thus provoking, also with a constant lever arm, the tilting of the auxiliary arm and the simultaneous lifting up of the counterweight.

Advantageously, control of the movement of the flexible cables is ensured by a single hydraulic thrustor whose cylinder is joined onto the main arm of the jig and whose rod is integral with a transversal linking member fixed at each extremity at a point of each of the two flexible cables. The thrustor is a twin effect thrustor and is associated with a three-position hydraulic fluid distributor having a central position isolating the two chambers of the thrustor of the hydraulic pump and the fluid tank, and two side positions connecting either of the chambers of the thrustor to the hydraulic pump and the remaining chamber to the tank by selectively controlling the coming out or retraction of the rod (15) of the thrustor.

BRIEF DESCRIPTION OF THE DRAWINGS

So as to clearly understand the invention, there follows hereafter a preferred non-restrictive embodiment given by way of example with reference to the accompanying diagrammatic drawing on which

DETAILED DESCRIPTION OF THE DRAWINGS

Figure 1:
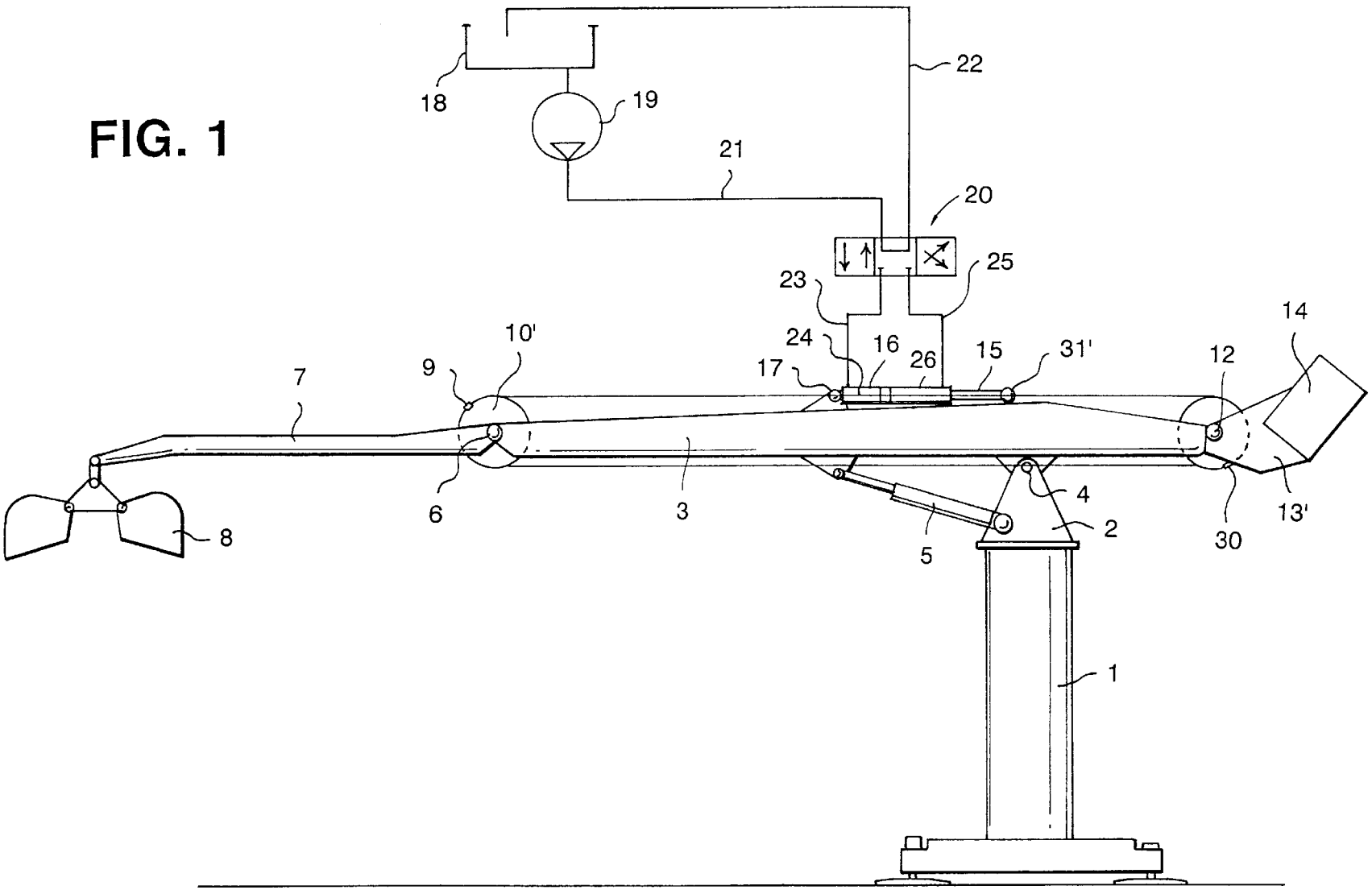
FIG. 1 is a side view of a crane jig with articulated arms equipped with an automatic balancing device according to the invention.

With reference to the drawing, the base of the crane is shown at 1, the pivoting turret at 2 topping this base and at 3 the main arm of the articulated jib towards its rear extremity at the top of the turret 2 around a horizontal pin 4 so as to be able to pivot inside a vertical plane under the control of a hydraulic thrustor 5.

Joined to the front extremity of the main arm 3 around a horizontal pin 6 is an auxiliary arm 7 whose front extremity bears a gripping element constituted in the example shown by a grab bucket 8.

Figure 2:
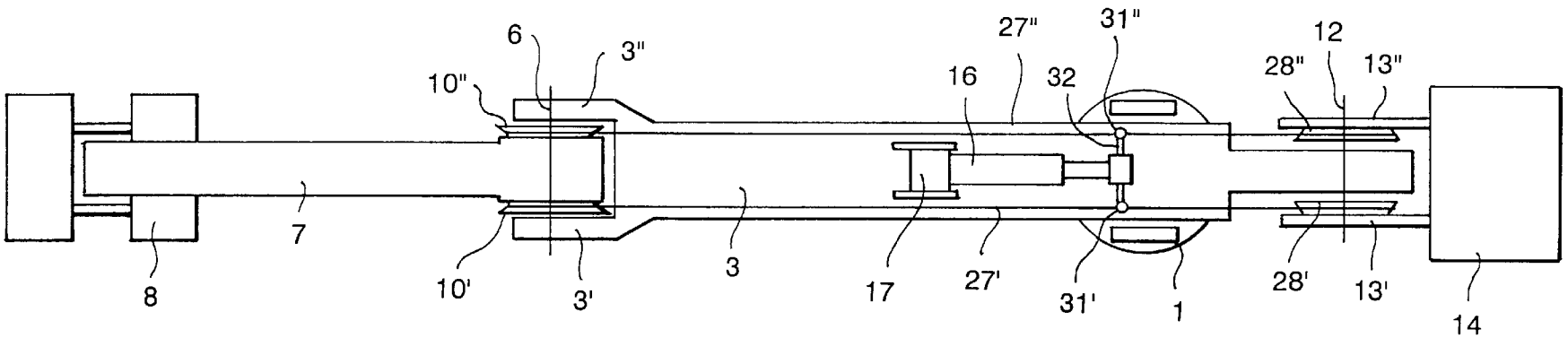
FIG. 2 is a top view of the crane jig of FIG. 1.

To this effect, as shown on FIG. 2, the front extremity of the main arm 3 has two spaced parallel axial branches 3', 3" pierced with holes opposite which the transversal horizontal hinge pin 6 pivots. The opposing side faces of the rear extremity of the auxiliary arm 7 are each integral with a throat pulley 10', 10" and the unit formed by the auxiliary arm 7 and the pulleys 10', 10" is traversed by the pin 6.

Joined to the rear extremity of the main arm 3 around a transversal horizontal pin 12 is a rocking arm with parallel arms 13', 13" arranged on both sides of the main arms 3 and bearing a counterweight 14.

Each arm 13', 13" of the rocking arm has its internal face integral with a throat pulley 28', 28" and the hinge pin 12 pivots inside holes opposite the main arm and the unit formed by each rocking arm 13', 13" and the associated throat pulley 28', 28".

Firstly, the throat pulleys 10', 28" and secondly 10"28" have one extending into the other, an endless flexible cable, respectively 27', 27" is placed on each of these pairs of pulleys 10'–28', 10"–28".

Each flexible cable 27', 27" comprises a fixing element at 9 on the respective front pulley 10', 10" and at 30 on the respective rear pulley 28', 28" so that the pulleys 10', 28' and 10", 28" are interconnected respectively.

A twin-effect hydraulic thrustor 16 is fixed with the aid of a hinge fork joint 17 above the main arm 3 and its rod 15 is fixed by means of a transversal linking bar 32 to the flexible cables 27', 27" at points 31', 31" respectively.

FIG. 1 shows in diagram form the hydraulic feed system of the thrustor 16. This system includes a hydraulic fluid tank 18, a hydraulic pump 19 connected to the tank 18 and a three-position hydraulic distributor 20. Ending at the distributor 20 is firstly a pressure pipe 21 connected to the pump 19 and a return circuit 22 connected to the tank 18, and secondly a pipe 23 connected to the full section chamber 24 of the thrustor 16 and a pipe 25 connected to the annular section chamber 26 of the thrustor 16.

By activating a control element (not shown), the distributor is able to take up the following 3 different positions (a central position shown on the drawing in which the pipes 23 and 25 ending at the thrustor 16 are isolated from the fluid feed and the tank, (a position corresponding to the left portion of the diagram of the distributor 20 of FIG. 1 in which the pipe 23 leading to the chamber 24 of the thrustor 16 is connected to the pump 19 and the pipe 25 leading to the chamber 26 of the thrustor 16 is connected to the tank 18, (a position corresponding to the righthand portion of the diagram of the distributor 20 of FIG. 1 in which conversely the chamber 24 of the thrustor 16 is connected to the tank 18 and the chamber 26 of the thrustor 16 is connected to the feed pump 19.

The functioning of the device of the invention is as follows. With the crane in the balanced position of FIG. 1, if the operator wishes to extend the range of the jig, he then places the distributor 20 in the position corresponding to the left-hand portion of its diagram of FIG. 1, that is when he feeds the chamber 24 of the thrustor 16 with fluid under pressure thus provoking the coming out of the rod 15 which, fixed to the cables 27', 27" at 31', 31" exerts traction on these cables so as to move them from the left towards the right with respect to FIG. 1. With the cables 27', 27" being fixed to the pulleys 10', 10" at 9 and to the pulleys 28', 28" at 30', 30", their movement results in the pulleys 10', 10" and 28', 28" rotating clockwise which simultaneously brings about lifting up of the auxiliary arm 7 and tilting of the counterweight 14. As the value of the counterweight 14 is calculated according to the actual weight of the elements of the jig and the grab bucket 8 and according to the diameter of the pulleys 10', 10" and 28, 28', the jig is thus fully or partially permanently balanced on the unit formed by the base 1 and the turret 2. When the desired elongation position of the jig is reached, the operator brings the distributor 20 back into its central position, thus immobilising the thrustor rod 15 and the operations for lifting up and lowering the load are then ensured by the thrustor 5.

If, conversely, the operator decides to shorten the range of the jig, he places the distributor 20 in the right-hand position of its diagram of FIG. 1, that is when he feeds the annular chamber of the thrustor 16 with fluid under pressure. Via its retraction movement, the rod of the thrustor 15 moves towards the left of FIG. 1 the cables 27', 27" which, via their linking points 9 and 30, 30" moves the pulleys 10', 10" and 28', 28" in rotation in an anticlockwise direction. This is then followed by a tilting of the auxiliary arm 7 and a simultaneous lifting of the counterweight 14 which ensure the automatic balancing of the jig.

The above description has been given by way of non-restrictive example and constructive additions or modifications could be made without departing from the context of the present invention.

What is claim is:

1. Variable length crane jig including a main arm mounted pivoting on a support turret, an auxiliary arm extending the main arm by being joined to the front extremity of the latter, a counterweight secured to a rocking arm joined to the rear extremity of the main arm, and linking means between said auxiliary arm and said rocking arm of the counterweight so as to embody at any moment a total or partial balancing of the jig, wherein a first pulley system mounted rotating at the front extremity of the main arm and integral in rotation with the adjacent extremity of the auxiliary arm, a second pulley system mounted in rotation at the rear extremity of the main arm and integral in rotation with the adjacent extremity of the main arm and integral in rotation with the adjacent extremity of the rocking arm, a flexible link connecting a point of the first pulley system to a point of the second pulley system and a control element for moving the flexible link ensuring the simultaneous pivoting of the auxiliary arm and the rocking arm so as to modify the length of the jig, thus ensuring balancing of the latter, said control element being borne by the main arm and being coupled to said flexible link so as to obtain a constant lever arm by keeping constant the torque required for balancing of the elements of the jig.

2. Variable length crane jig according to claim 1, wherein the front extremity of the main arm is extended by two spaced parallel arms providing between them a space for the rear extremity of the auxiliary arm, said rear extremity being traversed by a hinge pin pivoting inside openings opposite the arms.

3. Variable length crane jig according to claim 2, wherein each side face of the rear extremity of the auxiliary arm is integral with a throat pulley.

4. Variable length crane jig according to claim 1 wherein the pivoting arm integral with the counterweight has towards the front two parallel arms providing between them a space for the rear extremity of the main arm, said arms being mounted pivoting on a hinge pin pivoting inside a transversal opening of the rear extremity of the main arm.

5. Variable length crane jig according to claim 4, wherein the lower side face of each of said arms is integral with a throat pulley.

6. Variable length crane jig according to claim 5, wherein, on each side of the main arm, a flexible cable connects the front pulley to the rear pulley, said cable being fixed at a point of the front pulley and at a point of the rear pulley.

7. Variable length crane jig according to claim 6, wherein said device for controlling movement of the flexible link includes a hydraulic thrustor whose cylinder is joined onto a the main arm and whose rod is integral with a transversal linking member fixed to each extremity at a point of each of the two flexible cables.

8. Variable length crane jig according to claim 7, wherein the trustor is a twin effect thrustor and associated with a three-position hydraulic fluid distributor including a central position isolating the two chambers of the thrustor from a hydraulic pump and a tank, and two lateral positions connecting either of the chambers of the thrustor to the hydraulic pump and the remaining chamber to the tank by selectively controlling the removal or retraction of the rod of the thrustor.

9. Variable length crane jig comprising:

a support turret;

a main arm pivotally mounted to the support turret, the main arm having a first end and an opposing second end;

a counterweight secured to a rocking arm that is pivotally coupled to the first end of the main arm;

an auxiliary arm pivotally coupled to the second end of the main arm for extending the main arm;

a first pulley system rotatably mounted at the first end of the main arm for pivotally moving the rocking arm relative to the main arm;

a second pulley system rotatably mounted at the second end of the main arm for pivotally moving the rocking arm relative to the main arm;

a flexible link extending transversely across the main arm for connecting a point of the first pulley system to a point of the second pulley system; and a control mechanism for selectively moving the flexible link to cause simultaneous rotation of the first and second pulley systems which is translated into simultaneous pivoting of the auxiliary arm and the rocking arm so as to modify a length of the jig to thus ensure that the jig is balanced, wherein the control mechanism includes a component mounted to the main arm and coupled to the flexible link so as to obtain a constant lever arm by keeping constant the torque required for balancing of the elements of the jig.

10. Variable length crane jig according to claim 9, wherein the second end the main arm includes two spaced apart parallel arms that receive a first end of the auxiliary arm which is traversed by a hinge pin pivoting inside openings formed in the opposing arms.

11. Variable length crane jig according to claim 10, wherein each side face of the first end of the auxiliary arm is integral with a throat pulley.

12. Variable length crane jig according to claim 9, wherein the transverse linking element is coupled to a drive element of the component which is displaceable between a retracted position and an extended position.

13. Variable length crane jig according to claim 12, wherein movement of the drive element in a direction away from the linking element causes counterclockwise rotation of the first and second pulley systems resulting in the auxiliary arm moving in a downward direction and movement of the drive element in a direction towards the linking element causes clockwise rotation of the first and second pulley systems resulting in the auxiliary arm moving in a upward direction.

14. Variable length crane jig according to claim 9, further including a pair of flexible cables for connecting the first pulley system to the second pulley system, the pair of flexible cables being disposed on each side of the main arm.

* * * * *